US007757783B2

(12) United States Patent
Pfahlert

(10) Patent No.: US 7,757,783 B2
(45) Date of Patent: Jul. 20, 2010

(54) VIBRATIONAL APPARATUS

(75) Inventor: Roger Pfahlert, Timaru (NZ)

(73) Assignee: Flexidrill Limited, Auckland (NZ)

( * ) Notice: Subject to any disclaimer, the term of this patent is extended or adjusted under 35 U.S.C. 154(b) by 244 days.

(21) Appl. No.: 11/793,025

(22) PCT Filed: Dec. 14, 2005

(86) PCT No.: PCT/NZ2005/000329

§ 371 (c)(1),
(2), (4) Date: Sep. 14, 2007

(87) PCT Pub. No.: WO2006/065155

PCT Pub. Date: Jun. 22, 2006

(65) Prior Publication Data

US 2008/0135294 A1 Jun. 12, 2008

(30) Foreign Application Priority Data

Dec. 14, 2004 (NZ) ..... 537286
Jun. 17, 2005 (NZ) ..... 540852

(51) Int. Cl.
*E21B 7/24* (2006.01)

(52) U.S. Cl. ..... 175/56; 175/55; 74/25

(58) Field of Classification Search ..... 175/55, 175/56; 166/249, 177.6, 177.7; 139/134; 74/25

See application file for complete search history.

(56) References Cited

U.S. PATENT DOCUMENTS 3,199,614 A * 8/1965 Bodine, Jr. ..... 175/19
3,217,551 A * 11/1965 Bodine, Jr. ..... 74/87
6,129,159 A 10/2000 Scott et al. ..... 175/55
2003/0172860 A1 9/2003 Kong ..... 112/220

FOREIGN PATENT DOCUMENTS

WO 2004/009298 1/2004
WO 2004/113668 12/2004
WO 2005/087393 9/2005

* cited by examiner

*Primary Examiner*—Giovanna C Wright
(74) *Attorney, Agent, or Firm*—Jacobson Holman PLLC

(57) ABSTRACT

Vibrational apparatus capable of providing a vibrational output. The apparatus includes an assembly having a shuttle capable of shuttling between complementary structures, at least one of which complementary structures provides the vibrational output. The arrangement includes a drive to rotate the shuttle and there are magnetic interactions between the rotating shuttle and the complementary structures such that interactions with each complementary structure, and the phasing of the complementary structures relative to the shuttle, and alternating magnetic results forces in the shuttling movement of the shuttle.

16 Claims, 7 Drawing Sheets

VIBRATIONAL APPARATUS

This is a national stage of PCT/NZ2005/000329 filed 14 Dec. 2005 and published in English.

FIELD OF THE INVENTION

The present invention relates to a vibrational apparatus.

The present invention relates to a vibrational apparatus capable of providing a vibrational output for any one of a diverse range of purposes (e.g. whether for the purpose of vibrating a drill string, a hopper, a powder feed line, a conveyor, or the like).

BACKGROUND OF THE INVENTION

Many vibrational apparatus rely upon the rotation of an eccentric. Others rely on pneumatics and/or hydraulics in order to reciprocate a piston which provides a direct output of the vibrational output. Such structures however, whilst disclosed for many end uses, have a downside in that where the device to which the output piston is attached has itself stalled there is a difficulty in ensuring a recommencement of the vibrational output as a consequence of the piston itself refusing to move relative to its cylinder or the equivalent.

Vibrational heads whilst disclosed for many end uses, have a downside in that where the device to which the output piston is attached has itself stalled there is a difficulty in ensuring a recommencement of the vibrational output as a consequence of the piston itself refusing to move relative to its cylinder or the equivalent. Such would be the case with apparatus of PCT/NZ2003/000158 (published as WO 2004/009298) of Bantry Limited.

SUMMARY OF THE INVENTION

The present invention recognizes a significant advantage from the vibrational commencement point of view and/or tuning point of view (irrespective of how the apparatus is mounted). The advantage can be derived from a shuttle without a direct output to the apparatus to be vibrated.

Irrespective of the apparatus to be vibrated (i.e. whether apparatus in the form of a drill string or attachment for a drill string or not), we recognize an alternative mode of shuttle reciprocation to that disclosed in the aforementioned specifications. This is preferably one not requiring a fluid in variable geometry chambers.

We have determined we can provide magnetic interactions at each end of a guided shuttle that, as a result of a rotational drive provided to the reciprocal shuttle, drives such a shuttle back and forth thereby greatly simplifying operation.

Determined that by providing spaced magnets of a similar polar form and providing complementary magnets that alternate as to polarity at each end, it is possible by shuttle rotation to cause reciprocation without any striking of solid surface against solid surface. The tuning of the device relies on the inherent properties of the magnets involved, the nature of their arrays and the overall geometry of the instruction. Coupled to that there is the fact of the weight of the shuttle itself and the speed of its rotation.

We believe that permanent magnets can be utilized in such an arrangement effectively to allow a rotated shuttle to be tuned as far as its vibrational output is concerned. The timing of transition at each end from same pole to same pole to same pole to similar pole interactions is such as to avoid impact yet nonetheless provided vibrational output from the shuttle without any direct connection to any output device.

It is therefore an object of the present invention to provide a vibrational head that relies upon rotation of an element of the head thereby to provide magnetic interactions of a different kind (preferably but not necessarily at each end of a shuttle) thereby to shuttle the shuttle between limits preferably not dictated by any impact or cushioning but preferably rather magnetic to magnetic interactions despite any cushioning.

We have also determined it is possible with an air or other floating bearing or a magnetic levitation bearing to avoid heat build up between the rotating shuttle and the guiding member about which it is to be rotatable. Alternatively we have determined that stub axles at each end of a rotatable shuttle can themselves be floated or otherwise supported in a non-heat build up manner.

It is therefore to some aspects of such construction so the present invention is directed together with assemblies, methods of operations and uses.

The present invention, in some aspects, also recognizes at least one of the following as desirable irrespective of the form of the vibrational head:

an ability to drill to greater depth, an advantage in drill withdrawal, an advantage in drilling restarts, an advantage with vibrational drilling.

The present invention also or alternately sees an advantage in a maneuverable support of or frame to compliantly support a vibrational head. It is to the vibrational head to which lengths of the drill string are added. The compliant mounting or support advantageously allows the vibrational head degrees of freedom in movement non destructively of the support or frame yet which nonetheless confers (a) a benefit to drilling, an ability to drill to greater depth, a benefit in the situations of commencement, restart and/or withdrawal and/or (b) a benefit in apparatus longevity and/or simplicity over otherwise suspended vibrational heads and any attached or to be attached drill string.

It is to this therefore that the present invention is directed to at least provide the public with the useful choice.

The present invention consists in vibrational apparatus capable of providing a vibrational output, said apparatus comprising or including a shuttle having first and second ends, a first complementary structure associating with the first end of said shuttle, and a second complementary structure associating with the second end of said shuttle, wherein there is a drive or drives to rotate the shuttle about an axis through said complementary structures, and wherein magnets carried by the shuttle at each end and magnets carried by each complementary structure has the effect such that under the effect of rotation caused interactions, the first end moves away from the second complementary structure and, in turn, the second end moves away from the first complementary structure, and wherein the output of the vibration is from one or other, or both, of said complementary structures and not directly from the shuttle itself.

Preferably said first and second complementary structures are fixed relative to each other insofar as distance is concerned but not rotation relative to each other about said axis.

Preferably the drive type for the shuttle in each of its directions is the same but out of phase, although, in some less preferred forms of the present invention, a hybrid arrangement can be used.

Preferably the shuttling is without solid to solid high impact or impact contact.

Preferably the vibrational output is from one of the complementary structures.

The present invention also consists in vibrational apparatus capable of providing a vibrational output, said apparatus comprising or including a shuttle able to shuttle reproducibly on a shuttle axis or locus between first and second complementary structures, a drive to rotate the shuttle about at least part of the shuttle axis or locus, and magnetic interacting regions on each of at least one complementary structure and the shuttle whereby rotation of the shuttle has the effect of subjecting the shuttle to shuttle inducing forces being alternately attractive and repulsive forces between the or a complementary structure and the shuttle, and wherein the output of the vibration is from one or other, or both, of said complementary structures and not directly from the shuttle itself.

The present invention also consists in vibrational apparatus capable of providing a vibrational output, said apparatus comprising or including a shuttle rotatable about a defined shuttle axis and moveable back and forth on the shuttle axis, a drive to rotate the shuttle about its shuttle axis, a first complementary structure towards which and away from which, and vice versa, the shuttle moves, a second complementary structure away from which and towards which, and vice versa, the shuttle moves, the shuttle being between said complementary structures, wherein proximal regions of each pairing of first complementary structure/shuttle and shuttle/second complementary structure have magnetic areas operable to provide alternatively for each pairing attractive or repulsive forces as the shuttle rotates, and wherein the phasing between the pairings is, or can be, such that the shuttle reciprocates on its shuttling axis as a consequence of the magnetic interactions that act on the shuttle by virtue of its rotation, and wherein the vibrational output is from one or other, or both, of said complementary structures and not directly from the shuttle itself.

Preferably said first and second complementary structures are fixed relative to each other insofar as distance is concerned.

Preferably the shuttling is without solid to solid high impact or impact contact.

Optionally, but not preferably, said shuttle co-acts at least at one end with its complementary structure so as to provide a cushioning affect, e.g. by squeezing a fluid. Alternatively that can be at both ends. One or both ends of the shuttle (despite any guiding contact it may already have) can be adapted to contact part of the complementary structure only at the end of its shuttling travel or to contact some material interposed between that end of the shuttle and the complementary structure.

Preferably the vibrational output is from one of the complementary structures.

In still another aspect the invention consists in vibrational apparatus capable of providing a vibrational output, said apparatus comprising or including an assembly having a shuttle capable of shuttling between complementary structures, at least one of which complementary structures provides the vibrational output, the arrangement being characterized in that there is a mechanical drive to rotate the shuttle and there are magnetic interactions between the rotating shuttle and the complementary structures such that interactions with each complementary structure, and the phasing of the complementary structures relative to the shuttle, alternating magnetic results in the shuttling movement of the shuttle.

Preferably the magnetic interactions are as a result of permanent magnets.

Preferably the drive of the shuttle is a belt or other peripheral drive of the shuttle not deleterious to the shuttling movement of the shuttle between shuttling limits (preferably magnetically defined).

The present invention is directed to alternative vibrational head forms to those disclosed in our PCT/NZ2003/000128 (published as WO 2004/113668), and PCT/NZ2005/000047.

The invention also consists in a vibrational head for drilling that includes vibrational apparatus as aforesaid. It is also to the use of drilling apparatus having a floating or compliant support for a vibrational head of the present invention attached to or attachable to a drill string that the present invention is directed.

Preferably at least one, some or all of the following is included:

compliant restriction on one (or both) limit(s) of a or the shuttle stroke, compliant restriction on movement of the vibrational apparatus relative to its support, compliant bearing of the weight of the vibrational apparatus and any connected drill string, a drive to rotate the drill string independently of movement of rotation or lack of rotation of part or all of the vibrational apparatus, a top hat type support assembly to dangle the vibrational head.

In another aspect the invention is a drilling apparatus comprising a vibrational head of the present invention attached to or attachable to a drill string, a support, and at least one reconfigurable (e.g. compliant) fluid reservoir (e.g. a compliant gas bag) to carry yet constrain the vibrational head to the support, wherein the interaction of the vibrational head, the support and the at least one reconfigurable fluid reservoir has the effect of carrying the weight of the attached or the to be attached drill string yet allowing some freedom of movement of the vibrational head relative to the support both longitudinally and laterally of the drill string axis.

Preferably there are at least two reservoirs.

Preferably the fluid in at least one reservoir is a gas (e.g. air).

Preferably at least one, and preferably several or all, of the reservoirs is a gas bag.

Preferably the support is a frame.

Preferably most of the vibrational head (when the drill axis is vertical) is below the reservoir(s).

Preferably the longituding support allows a greater freedom of movement than the lateral support but not necessarily so.

Preferably irrespective of how the shuttle is caused magnetically to shuttle there is (a) preferably a vibrational outtake not directly from the shuttle, (b) the shuttle reciprocates, (c) the shuttle preferably impinges at each end of its stroke on a compliant structure, (d) a or each complaint structure may be a gas bag, (e) the compliant structure(s) preferably can be varied in character to affect stroke by a variation of a fluid or gas supply, (f) the vibrational outtake is not from a compliant structure but is via a compliant structure, (g) the shuttle may or may not rotate on its stroke axis.

Preferably the vibrational outtake from the vibrational head into the drill string is via a transition from a non rotating but vibrating component directly or indirectly into a rotatable and rotating component (e.g. connectable to or forming part of the drill string).

In another aspect the invention is a drilling apparatus comprising a vibrational head of the present invention attached to or attachable to a drill string, a support, at least one gas bag interposed between part(s) of the vibrational head and the support, as a first interaction, to carry the weight of the vibrational head and the or any attached drill string, and at least one gas bag interposed between the support and part(s) of the vibrational head, as a second interaction, to constrain the vibrational head relative to the support whereby said first interaction is not totally lost during any part of the vibrational cycle of the vibrational head.

Preferably part(s) of the vibrational head is (are) interposed between top and bottom constraints provided by said support and at least one air bag is interposed above the part(s) and below one constraint and at least one air bag is interposed below the part(s) and above the other constraint.

Preferably most of the vibrational head is below said part(s).

The arrangement is such as to provide freedoms of movement of the vibrational head and its carried or to be carried drill string relative to the support yet able, responsive to weight, to bias to a datum condition of the vibrational head relative to the support.

In another aspect the invention is a drilling apparatus comprising a vibrational head attached to or attachable to a drill string, the vibrational head having laterally of the longitudinal axis defined, or to be defined, by the drill string one or more projection(s) to define at least one upper surface and at least one lower surface, a support frame for the vibrational head, at least one gas bag to act between the frame and said at least one upper surface, and at least one gas bag to act between the frame and said at least one lower surface.

Preferably the vibrational head has provision both for a compliant (e.g. gas bag or the like) limitation at each end of a shuttle stroke and a compliant (e.g. gas bag or the like) mounting of the vibrational head itself from a support or frame.

Preferably both the upper surface(s) and the lower surface(s) are nearer the top than the bottom of the vibrational head.

In another aspect the invention is a drilling apparatus comprising a vibrational head attached to or attachable to a drill string, a support, and wherein (I) the vibrational head has a shuttle compliantly restricted in its stroke at least in part by compliant means, and (II) the vibrational head is compliantly supported by the support, and wherein the support via the compliantly supported vibrational head is adapted to carry the weight of the attached or the to be attached drill string yet allow some freedom of movement of the vibrational head relative to the support both longitudinally and laterally of the drill string axis.

Preferably there are at least two reservoirs of a fluid to provide a compliant support of the vibrational head.

Preferably the fluid in at least one reservoir is a gas (e.g. air).

Preferably at least one, and preferably several or all, of the reservoirs is a gas bag.

Preferably the support is a frame.

Preferably most of the vibrational head (when the drill axis is vertical) is below the reservoir(s).

Preferably the longituding support allows a greater freedom of movement than the lateral support but not necessarily so.

Preferably the compliant restriction of the shuttle is a reservoir of a fluid at an end of the shuttle when at a limit of a stroke.

In another aspect the invention is a drilling apparatus comprising a vibrational head attached to or attachable to a drill string, the head having a rotatably driven shuttle that rotates about is shuttling axis and interacts under rotation with different magnetic effects thereby to be shuttled, the vibrational output not being from the shuttle itself, a support, compliant means (e.g. preferably at least one gas bag interposed between part(s) of the vibrational head and the support), as a first interaction, to carry the weight of the vibrational head and the or any attached drill string, and compliant means, as a second interaction, (preferably to constrain the vibrational head relative to the support) whereby said first interaction is (preferably) not totally lost during any part of the vibrational cycle of the vibrational head.

Preferably the vibrational head includes a shuttle compliantly restricted as to stroke.

Preferably part(s) of the vibrational head is (are) interposed between top and bottom constraints provided by said support and at least one air bag is interposed above the part(s) (e.g. as one option of said compliant means) and below one constraint and at least one air bag is interposed below the part(s) and above the other constraint.

Preferably most of the vibrational head is below said part(s).

Other options exist for the compliant means including a spring, a compressible fluid in a variable volume reservoir, an incompressible or compressible fluid, or both, in a bag, bellows, or any such variable geometry containment, resilient or otherwise.

The arrangement is such as to provide freedoms of movement of the vibrational head and its carried or to be carried drill string relative to the support yet able, responsive to weight, to bias to a datum condition of the vibrational head relative to the support.

In another aspect the invention is a drilling apparatus comprising a vibrational head of the present invention attached to or attachable to a drill string, the vibrational head having laterally of the longitudinal axis defined or to be defined by the drill string one or more projection(s) to define at least one upper surface and at least one lower surface, a support frame for the vibrational head, at least one gas bag to act between the frame and said at least one upper surface, and at least one gas bag to act between the frame and said at least one lower surface, and wherein the vibrational head has a drill string rotational drive to or adjacent its connection for a drill string.

In a particularly preferred embodiment of the present invention preferably the apparatus is vibrational drilling apparatus comprising a vibrational head having a shuttle yet a vibrational outtake not directly from the shuttle, a manoeuvrable support from which the vibrational head is mounted to compliantly vibrate under the action of the shuttle, a bearing supported from the vibrational outtake from the vibrational head, and a drill string connector carried by the bearing, a rotational drive to the drill string connector, wherein the shuffle interacts in use magnetically at each of its ends as it rotates under a drive of the shuttle thereby to reciprocate under effect of such interactions.

Preferably the rotary drive to the drill string connector is from a flexible transmission from a motor engine or other power source, (e.g. combustive, hydraulic, pneumatic, electric, or the like).

Preferably the flexible drive is of a belt able to provide a rotary transmission having some capability of reducing transmission of shock from the drill string connector to the support yet able to allow vibrational movement of the drill string connector through the bearing from the outtake.

The present invention also consists in vibrational apparatus capable of providing a vibrational output, said apparatus comprising or including a shuttle able to shuttle reproducibly on a shuttle axis or locus between first and second complementary structures, a drive to rotate the shuttle about at least part of the shuttle axis or locus, and magnetic interacting regions on each of at least one complementary structure and the shuttle whereby rotation of the shuttle has the effect of subjecting the shuttle to shuttle inducing forces being alternately attractive and repulsive forces between the or a complementary structure and the shuttle, and wherein the output of the vibration is from one or other, or both, of said complementary structures and not directly from the shuttle itself.

Preferably at least one, some or all of the following is included;

- compliant restriction on one (or both) limit(s) of a or the shuttle stroke
- compliant restriction on movement of the vibrational apparatus relative to its support
- compliant bearing of the weight of the vibrational apparatus and any connected drill string
- a drive to rotate the drill string independently of movement of rotation or lack of rotation of part or all of the vibrational apparatus
- a top hat type support assembly to dangle the vibrational head.

The present invention also consists in vibrational apparatus capable of providing a vibrational output, said apparatus comprising or including a shuttle rotatable about a defined shuttle axis and moveable back and forth on the shuttle axis, a drive to rotate the shuttle about its shuttle axis, a first complementary structure towards which and away from which, and vice versa, the shuttle moves, a second complementary structure away from which and towards which, and vice versa, the shuttle moves, the shuttle being between said complementary structures, wherein proximal regions of each pairing of first complementary structure/shuttle and shuttle/second complementary structure have magnetic areas operable to provide alternatively for each pairing attractive or repulsive forces as the shuttle rotates, and wherein the phasing between the pairings is, or can be, such that the shuttle reciprocates on its shuttling axis as a consequence of the magnetic interactions that act on the shuttle by virtue of its rotation, and wherein the vibrational output is from one or other, or both, of said complementary structures and not directly from the shuttle itself.

Preferably at least one, some or all of the following is included;

- compliant restriction on one (or both) limit(s) of a or the shuttle stroke
- compliant restriction on movement of the vibrational apparatus relative to its support
- compliant bearing of the weight of the vibrational apparatus and any connected drill string
- a drive to rotate the drill string independently of movement of rotation or lack of rotation of part or all of the vibrational apparatus
- a top hat type support assembly to dangle the vibrational head.

Preferably said first and second complementary structures are fixed relative to each other insofar as distance is concerned.

Preferably the shuttling is without solid to solid high impact or impact contact.

In still another aspect the invention consists in vibrational apparatus capable of providing a vibrational output, said apparatus comprising or including an assembly having a shuttle capable of shuttling between complementary structures, at least one of which complementary structures provides the vibrational output, the arrangement being characterised in that there is a drive to rotate the shuttle and there are magnetic interactions between the rotating shuttle and the complementary structures such that interactions with each complementary structure, and the phasing of the complementary structures relative to the shuttle, alternating magnetic results in the shuttling movement of the shuttle.

Preferably at least one, some or all of the following is included;

- compliant restriction on one (or both) limit(s) of a or the shuttle stroke
- compliant restriction on movement of the vibrational apparatus relative to its support
- compliant bearing of the weight of the vibrational apparatus and any connected drill string
- a drive to rotate the drill string independently of movement of rotation or lack of rotation of part or all of the vibrational apparatus
- a top hat type support assembly to dangle the vibrational head.

Preferably the magnetic interactions are as a result of permanent magnets.

Preferably the drive of the shuttle is a belt or other peripheral drive of the shuttle not deleterious to the shuttling movement of the shuttle between shuttling limits (preferably magnetically defined).

Optionally there is no reliance upon the provision of an externally pressurised fluid as a means of empowerment of shuttle movement by being introduced so as to pressurise without further event between a complementary structure and said shuttle.

As used herein "shuttle" has the broadest meanings with respect to what moves and what does not, etc. Preferably it is a shuttle to move rectilinearly.

As used herein the term "and/or" means "and" or "or", or, where the context allows, both.

As used herein the term "comprises" or "comprising" can mean "includes" or "including".

As used herein the term "(s)" following a noun can mean both the singular and plural versions of that noun.

As used herein the terms "stroke" or "stroke limit" can refer to limits of a rectilinear stroke or any curved stroke (e.g. can swing about a pivot axis or other support, whether fixed or moving).

As used herein "compliant" and variations thereof refer to the character of any structure, whether a gas bag, gas spring or the like, or not, able to achieve a desired stated outcome (e.g. stroke limitation, shock reduction, damping, impact avoidance, etc.).

Optionally there is no reliance upon the provision of an externally pressurised fluid as a means of empowerment of shuttle movement by being introduced so as to pressurise without further event between a complementary structure and said shuttle.

As used herein "and/or" refers to "and" or "or".

As used herein "(s)" following a noun can refer to the singular or plural.

BRIEF DESCRIPTION OF THE DRAWINGS

Preferred forms of the present invention will now be described with reference to the accompanying drawings in which.

DETAILED DESCRIPTION OF PREFERRED EMBODIMENTS

By way of an example one preferred form of the present invention with reference to a drill string vibrating apparatus adapted to attach to a drill string 13.

The apparatus howsoever mounted (preferably compliantly suspended) has end members 15 and 16 that act as a first complementary means and 18 and 20 which act as a second complementary means. These complementary means are held in a fixed relationship by the members 19. The shuttle 17 moves back and forward within the physical bounds provided and ideally has a lesser shuttling distance to avoid impacting.

It matters not whether or not the shuttle itself acts as a piston within a bore of a complementary end or vice versa. Nor does it matter if there is no piston in cylinder relationship at all. It is the shuttling that is important howsoever caused.

Figure 1:
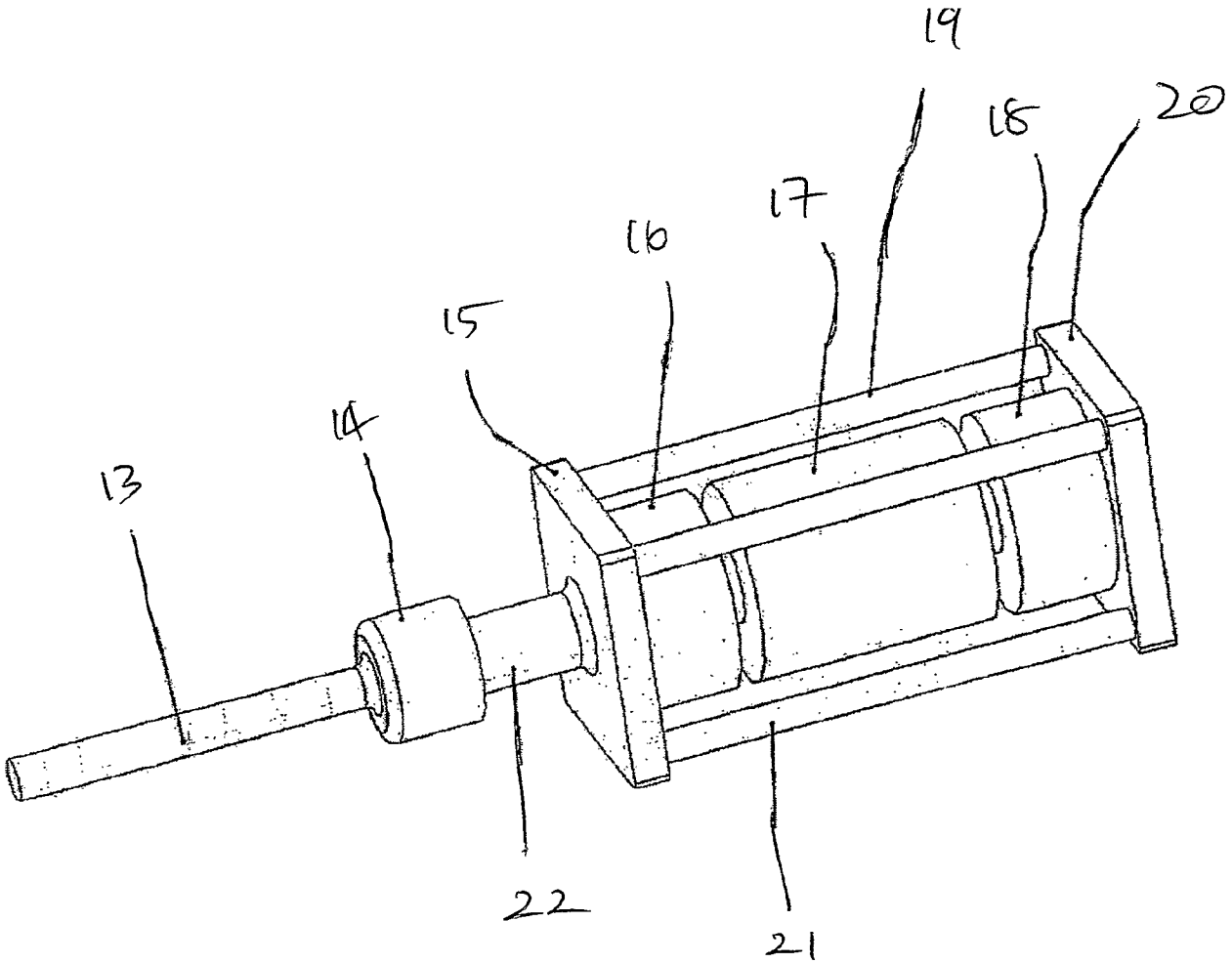
FIG. 1 is a diagrammatic view of preferred apparatus in accordance with the present invention.

With reference to FIG. 1 the following is depicted.

(13) Drill string
(14) Rotary joint/drive pulley
(15) End plate
(16) Adjacent member
(17) Shuttle
(18) Adjacent member
(19) Tie rods
(20) End plate The purpose of the shuttle 17 is to transfer energy onto the adjacent members 16 and 18 in a reciprocal motion. This transfer of energy can be achieved, as in the past, by the injection of oil between the shuttle and its adjacent members with the appropriate timing to cause the shuttle to move in a reciprocal motion, thus to cause the drill string to move in a linear motion in parallel with the shuttle motion thus transferring the energy down the drill string to the bit in the most efficient manner. With the present invention however we prefer the magnetic interaction approach to be described hereafter.

The shuttle mass is the key to the transfer of the energy to the adjacent members. The change in direction of travel imparts the energy to the adjacent members. The more mass the shuttle has the greater the energy required to achieve this change in direction and is directly linked to the horse power required. The relationship between the mass of the shuttle and the total mass of the drill string being vibrated has to be considered and sized appropriately.

The shuttle action has the advantage of never being in a situation of being stalled by locking or binding of the drill string in the drill hole. The shuttle can deliver full power to the drill string or attachments that may be fitted.

The end plates and tie rods (19, 20) are the link between the adjacent members and these transfer the reciprocating energy to the drill string.

The shuttle is preferably reciprocated by magnetic means. Ends of the shuttle have electromagnets or (preferably) rare earth magnets fitted in such an arrangement that when the shuttle 17 was rotated it would pulse responsive to adjacent members also fitted with magnets in such a way that would cause the shuttle to reciprocate. This will be described hereafter with particular reference to the embodiment of FIGS. 2 to 7.

Hybrids of the foregoing and/or other drives can be used.

The examples above all have a common theme.

(1) The shuttle preferably never needs to touch the adjacent members in a physical sense as this could damage the magnets and the drill string joints together with the associated down hole equipment.

(2) The movement of the shuttle preferably is never dependent on the drill string or attached equipment, being free to move in relation to the movement of the shuttle.

(3) The shuttle action preferably drives the drill string in both directions i.e. in and out and in doing so allows drill bit rotation to move with very little drag on the drill bit carbides. This action allows for back reaming of holes.

Other drill action involving a drifter do not power the drill string out of the hole while drilling the hole "IN". They rely on the bounce of the drill string.

A drifter hits steel on steel and in doing so causes a destructive shock wave through the drill string.

N.B. A drifter is the name given to a conventional hydraulic rock drill.

A preferred form of the invention with its magnetic drive will now be described.

Figure 2:
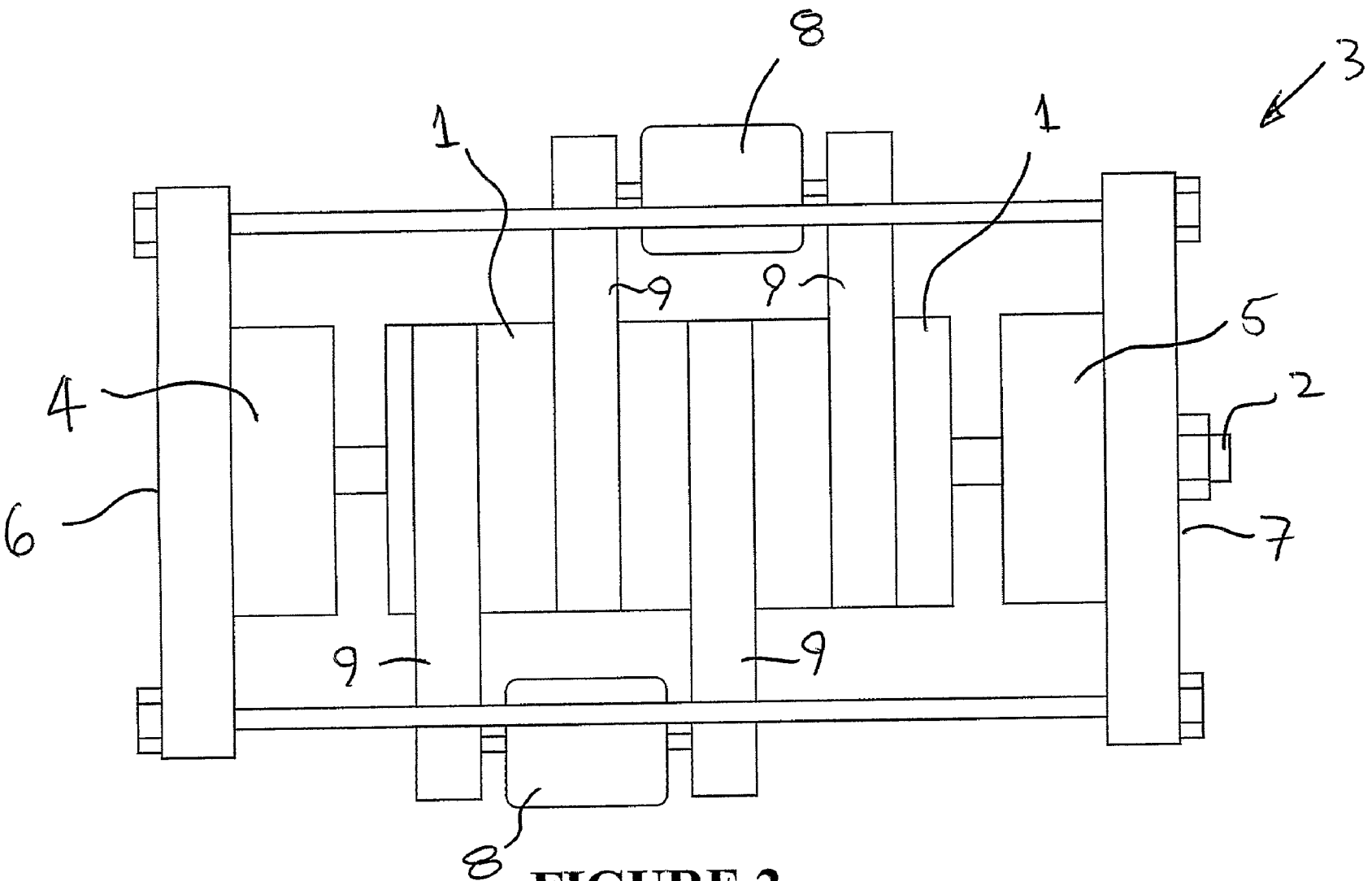
FIG. 2 is a plan diagram of apparatus in accordance with the present invention showing a frame having fixed complementary members at each end of a shuttling guide for the shuttle and showing motor drives connected by belts to rotate the shuttle.

FIG. 2 shows the shuttle 1 on a fixed guide shaft 2 supported by the frame 3 which carries the fixed first and second complementary structures 4 and 5 respectively.

The power output of the vibration can be from 6 or indeed the end 7 or any other take off linked to the frame 3.

Motors 8 preferably drive belts 9 adapted to rotate the shuttle 1 yet provide for a limited amount of axial movement of the shuttle as it rotates so as to provide the shuttling effect which gives rise to the vibrational outtake at 6, 7 or via 3.

Figure 3:
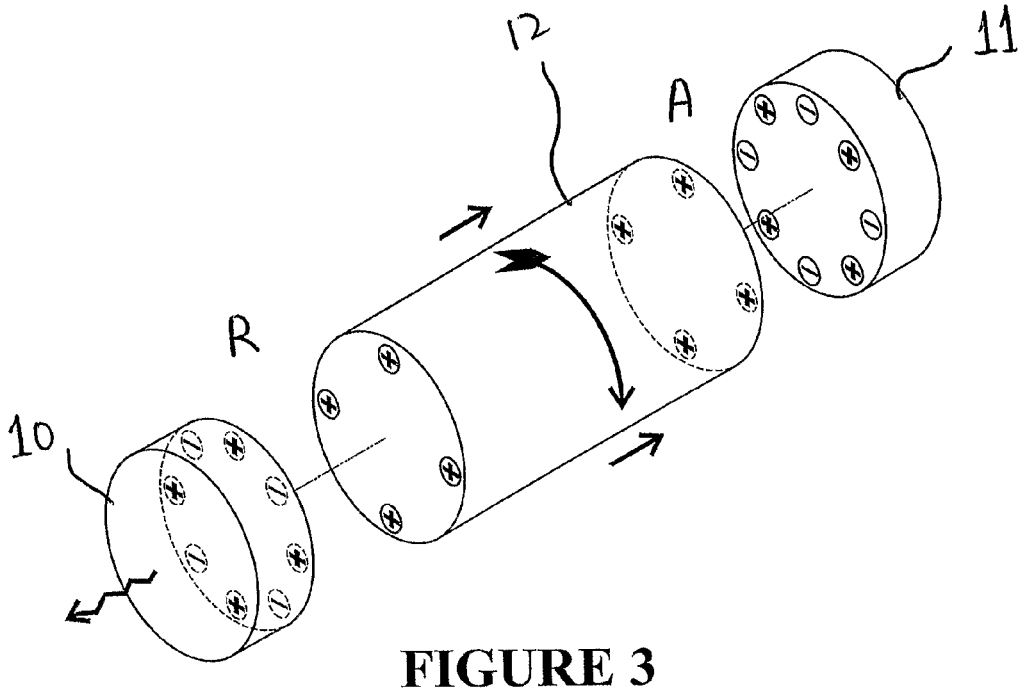
FIG. 3 is a diagrammatic view showing rotation of the shuttle in a clockwise sense between the fixed complementary members and showing with "R" and "A" a circumstance of repulsion and attraction respectively between a complementary component and the shuttle and between the shuttle and the other complementary member such that there is a net shuttling thrust on the shuttle in the arrowed direction.
Figure 4:
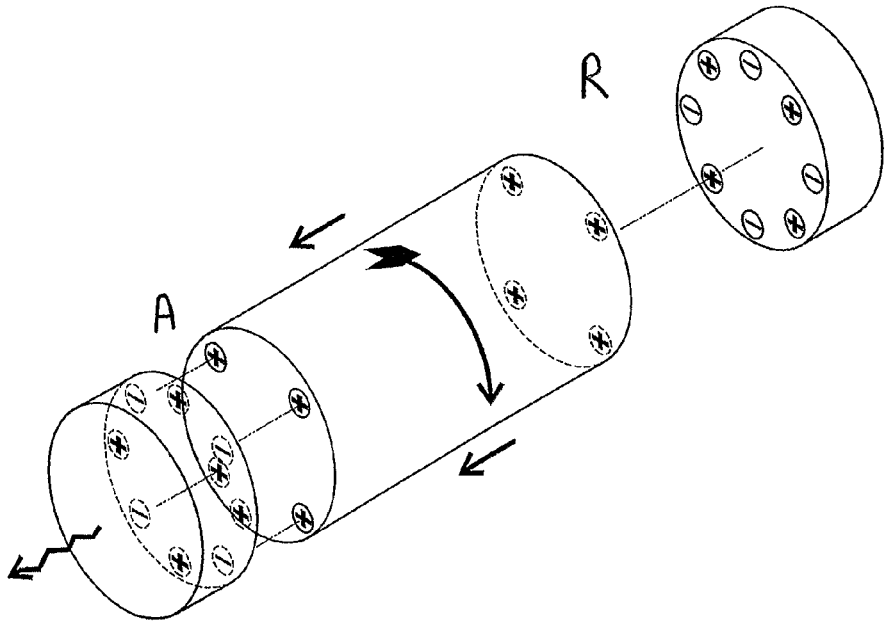
FIG. 4 shows the arrangement as in FIG. 3 at a moment in time later when there is a reversal of the attractive "A" and repulsive "R" forces between the pairings of the fixed complementary component and the shuttle, the shuttle having shuttled in the arrowed direction.

FIGS. 3 and 4 by reference to regions of different polarity of permanent or other magnets shows the effect. The broken zigzagging arrow is indicative of power take off from a first complementary structure 10. In the arrangement shown however there is a second complementary structure 11 shown out of phase so far as the "plus" and "minus" polarities depicted are concerned. The shuttle 12 preferably has the same polarity at each end such that, in a condition as shown in FIG. 3, there is a net repulsive force arising from alignment of "plus" and "plus" polarities between the shuttle 12 and the first complementary structure 10 whilst, at the same time, there is a "plus" and "minus" attractive force "A" between the shuttle 12 and the second complementary structure 11. A short moment in time later the opposite situation, as depicted in FIG. 4, exists and it is this rapid alternating of "R" and "A" to "A" and "R" that leads to the reversal in shuttle direction as the shuttle rotates.

Figure 5:
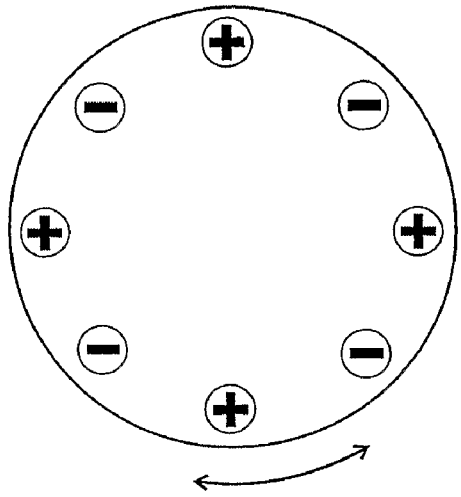
FIG. 5 is a diagram of, for example, the second complementary component.
Figure 6:
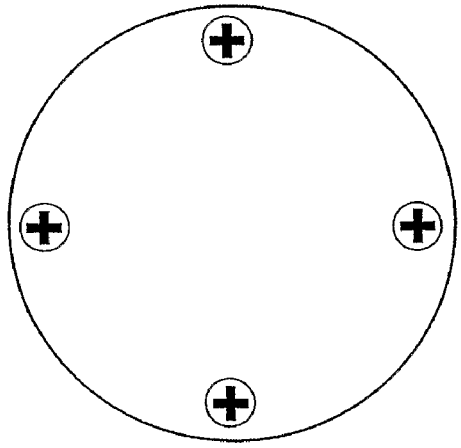
FIG. 6 is a diagram of each end of the shuttle although it is not necessary for the polarity of each end of the shuttle to be the same as the other although this is most preferred.
Figure 7:
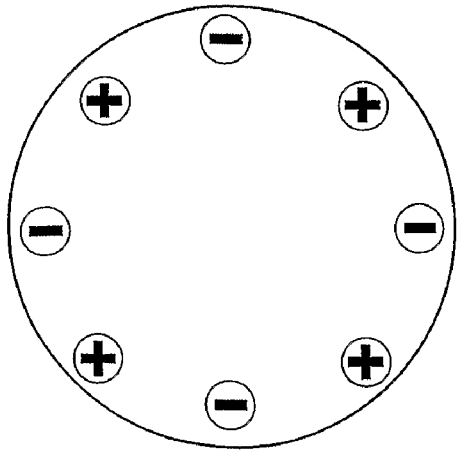
FIG. 7 is a similar view to that of FIG. 5 but of the first complementary component (e.g. that from which there can be the output) showing in an outer phase condition relative to the component of FIG. 5, the sweep arrow in FIG. 5 showing how provision can be made under the action of a ram or other external force of rotating one component so as to detune or tune the apparatus as may be required from time to time for service access or for control of amplitude and frequency.

In some forms of the present invention, provision is made whereby the 180° out of phase situation shown for the complementary structures 10 and 11 can be varied and this is shown by reference to a sweep arrow in respect of FIG. 5. This can be under the action of a ram or other means (not shown) such that during operation the phasing can be moved away from the 180° out of phase situation, or from some other situations, to one that may provide a better tuned frequency of shuttling and amplitude of shuttling on the shuttle axis.

The outtake of vibration is preferably as shown in FIGS. 3 and 4 via the first complementary structure 10.

Even in variations of the invention where there is not the double ended magnetic interaction described with reference to FIGS. 3 to 7, there can nonetheless be a shuttling effect provided there is an adequate means of return of the shuttle alternatively provided. Examples of such provision have been given previously.

Also within the scope of the present invention is the use of the magnetic interactions at or not at the end of the assembly from which the vibrational outlook is taken.

It is believed however, that the interactions of the magnet carrying shuttle with a complementary structure will be such as to provide desirable vibrational output useful in drilling and other vibrational tools. It is seen that the arrangement of the present invention is an alternative to, or can be ancillary to other inputs for the end use purposes, arrangements disclosed in our PCT applications PCT/NZ2004/000128 and PCT/NZ2005/000047.

Preferably used are permanent magnets (particularly Rare Earth type magnets of high magnetic density, e.g. Neodymium magnets, such as those of NdFeB, can be stable to 180° C. and Samarium Cobalt magnetic (FmCo) which can be used up to 400° C.).

Other forms of magnet can be utilised including those magnets that may be developed in the future. Generally speaking however, electro magnets are contra-indicated purely from the point of view of size and the need to provide adequate electrical inputs in a structure that does vibrate and is subject to adverse environments.

It is envisaged that rotational speeds for the shuttle 1 can vary significantly. A mere example of one such rotation is 1600 RPM which is sufficient, with magnets as depicted, to provide a sufficient throw of the shuttle backwards and forwards to provide a worthwhile vibrational output. Usual ranges can be from 1000 to 2000 RPM but can be higher or lower. 2000 RPM equates to approximately 130 Hz.

A different embodiment form of the present invention will now be described by reference to FIG. 8.

Figure 8:
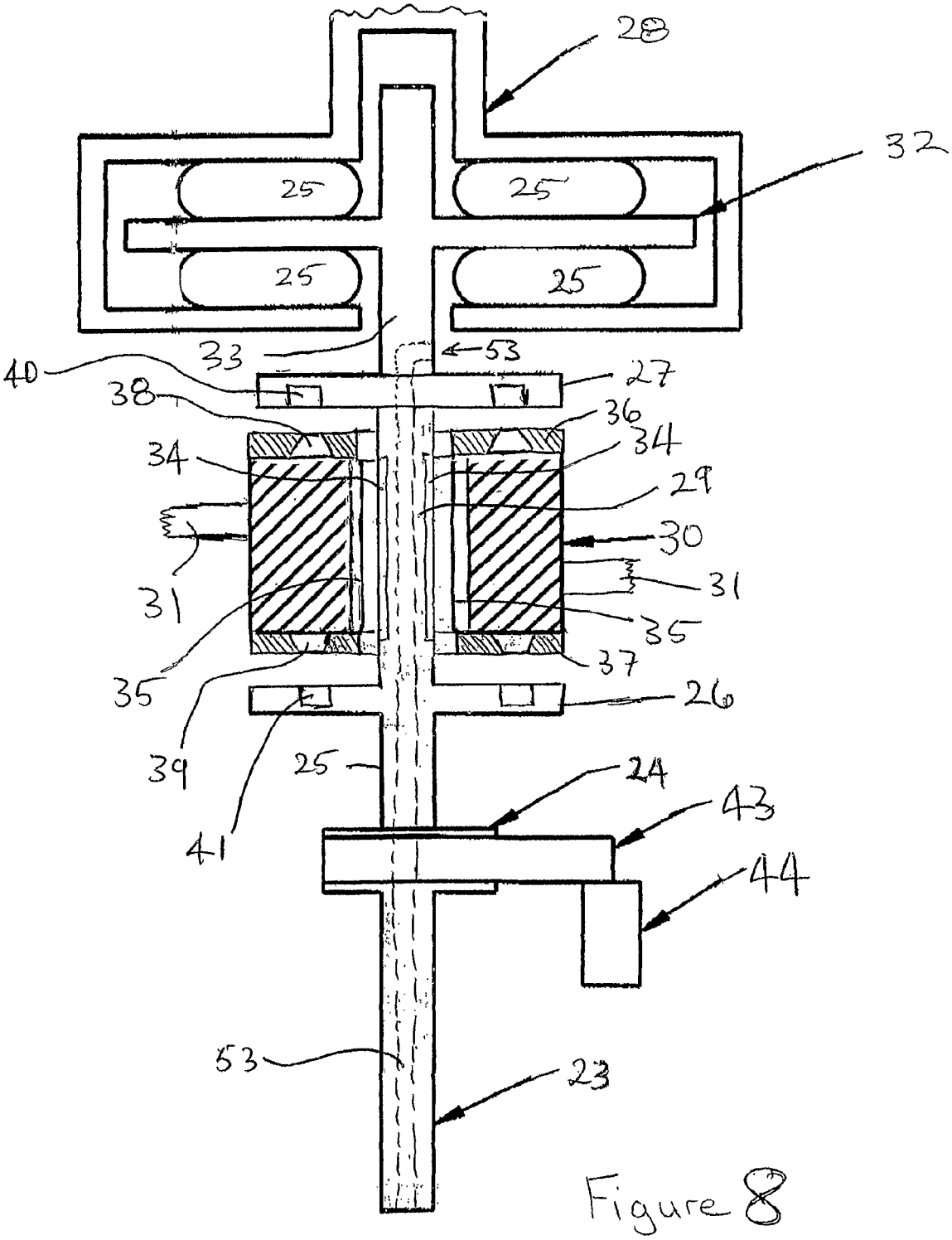
FIG. 8 shows a drilling head in accordance with the present invention suspended so as to carry a vibrating head in accordance with the present invention, the vibrating apparatus itself being shown in partial section.

In FIG. 8 a main air or fluid (gas) bag group (25) co-acting between vibration apparatus part 28 being a fixed or manoeuvrable drill head frame assembly as shown. This assembly provides the drill string (23) with the ability to float in the drill hole while operating regardless of the weight of the drill string as it is constantly being adjusted by air valves (not shown) to provide equal pressure on the drill string fixture 32 held between the air bags (25). This assembly also provides the insulation between the moving mass of the drill string shaft (29) and shuttle assembly and the drill rig structure or support/frame (28).

Those two functions are preferred and can prove to be critical in the operation of the head.

End plates 27 and 26 ("complementary structures") are to provide output to the drill string 23 via shaft 29 and its extension 25. A rotation bearing assembly 24 as a transition allows rotation to the drill string shaft 29. Above the bearing assembly 24 the vibrational outtake is independent of drill string rotation i.e. 25 need not rotate. The rotary input to the drill string spindle below 24 is preferably provided by a wide tooth belt assembly 43 driven by a fixed motor 44. The distance between the drives is such the movement of the drill string and the associated vibration is dissipated by the belt drive and therefore is not transmitted to the drill structure. The belt drive is also such as not to fail owing to the vibration.

Preferably the drive of the shuttle rotation is an electric, pneumatic or hydraulic motor (42) driven flexible drive. Preferably several drive belts 31 are used. Such belts preferably can accommodate the amplitudes of movement required.

In other drive forms the shuttle can be impelled to rotate reliant on vanes being struck by a fluid (e.g. air, water or the like). Other options for a drive also exist or can be used.

As far as the vibrational apparatus is concerned, it can be seen that an end plate 27 carries an array of magnets 40 to coact with an array of magnets 38 at that end of the shuttle 30. Similarly an end plate 26 has carried magnets 41 as an array to coact with the array of magnets 39 held to the shuttle at the other end.

As can be seen, each of the magnets 38 and 39 are shown as preferably frustoconical or shaped forms capable of being held by retention plates 36 and 37 to the main body of the shuttle 30.

That main shuttle body preferably is lined with permanent magnets 35 of a first pole which are to be magnetically levitated about the magnetic lining 34 of a second pole of the shaft 29.

Figure 9:
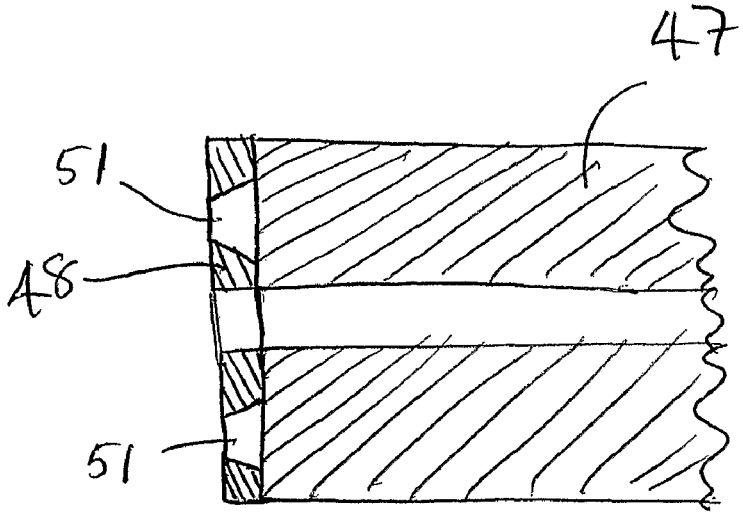
FIG. 9 shows a suitable assembly procedure for retaining magnets to the shuttle reliant upon a frustoconical form of the magnets held to the shuttle by a fixed plate.
Figure 10:
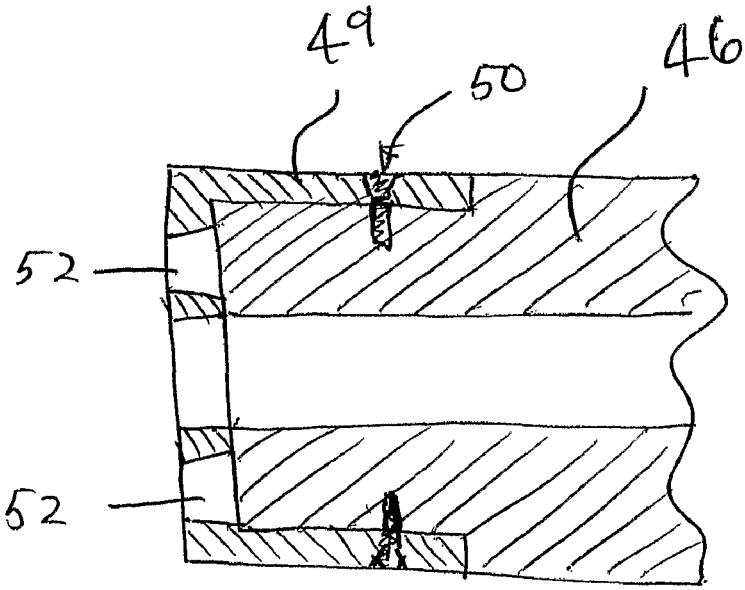
FIG. 10 is a different embodiment to that of FIG. 10 showing how a machined or moulded frustconical or other shaped magnet support can be fixed into the shuttle in a manner less likely to be subjected to disruption from the shuttling vibration.
Figure 11:
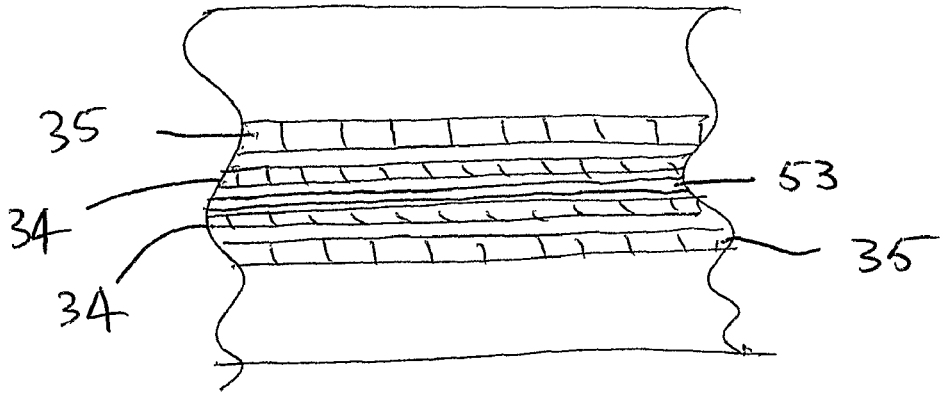
FIG. 11 shows part of a preferred maglev bearing shuttle assembly.
Figure 12:
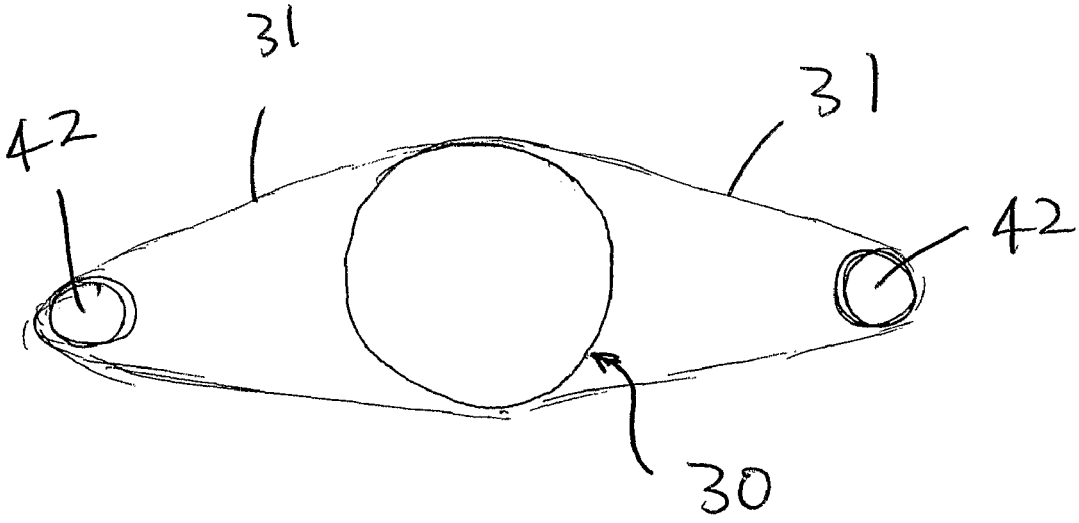
FIG. 12 shows matched (two in this case but could be three or more) belt drives for the shuttle.

Preferably the arrangement is as previously described. If there is a difficulty owing to the intensity of the reciprocation to retain plates 36 and 37 to the main body of the shuttle 30, optionally, rather than the arrangement as shown in FIG. 9 where magnets 51 are simply held to the end of the main body 47 by an end plate 48 which can be fixed by adhesion, screwing, bolting or the like (not shown), alternatively, a member 49 can be provided to achieve the same purpose for the magnets 52 by screwing radially at 50 into the main body 46 of the shuttle.

Whilst preferably the magnets are exposed at the end of each shuttle, in some instances there can be a protective covering provided that does not interfere with the effectiveness of the magnetic interaction. Likewise for the fixed magnets 40 and 41 of the end plates 27 and 26 respectively. These can be retained similarly to the shuttle or simple adhesion may suffice.

It is envisaged that end plate 27 is able to be rotated (e.g. by 45° C.) so that when desired the shuttle 30 can be kept at a stable condition between the end plates 27 and 26 irrespective of whether being rotated or not. To achieve this the out of phase arrangement previously described in some detail is used so that there is some balancing of the forces. Just what, if any, rotation of the plate 27 is required depends on the set out of the arrays and the magnetic inclusions in the interacting surfaces.

The magnetic support of the shuttle on a guiding axis is preferred but in other alternative forms some air or other support can be provided. This is to avoid any unnecessary heat build up which may degrade the performance of the permanent magnets. Systems in accordance with the present invention that have been provided with a lubricated bearing have tended to generate some heat but such systems nonetheless can be operated if there is cooling of any lubricant or the operating parameters are such as to not generate temperatures above the degrade temperatures of the permanent magnets.

Also provided is the prospect of a fluid pathway 53 that extends through the apparatus into the drill string thus providing a flushing capability as well as a prospect of a cooling function. Such a fluid can be air, a liquid (e.g. water) or can include a lubricant fluid typically (e.g. a slurry) used in drilling.

With the arrangement of FIGS. 8 to 12, if for example, the shuttle is 1.5 m long and the amplitude of shuttle movement is from 0.1 mm to 15 mm (depending on shuttle rotation speeds, shuttle mass, magnetic arrays, magnetic strengths, geometry and clearances).

Preferably a cycling frequency of from (preferably) above 20 cycle/sec to say, 200 cycles/sec are contemplated in steady state conditions. A frequency 200 cycles/sec can easily be generated using 4/8 magnetic interactions as in FIGS. 2 to 7 reliant on shuttle rotation of about 3000 RPM.

The invention claimed is:

1. Vibrational apparatus capable of providing a back and forth vibrational output, said apparatus comprising a shuttle having first and second ends, a first complementary structure associated with the first end of said shuttle, and a second complementary structure associated with the second end of said shuttle, at least one mechanical drive to rotate the shuttle about an axis extending through said first and said second complementary structures, magnets carried by the shuttle at each end and magnets carried by each of the first and the second complementary structures having a vibration effect such that under the effect of rotation caused interactions, the first end moves away from the second complementary structure and, in turn, the second end moves away from the first complementary structure, and an output of the vibration effect originates from at least one of said complementary structures and is a back and forth output axially of, or parallel to, said axis.

2. The apparatus of claim 1, wherein said first and second complementary structures are fixed relative to each other insofar as distance is concerned.

3. The apparatus of claim 1, wherein the complementary structures are carried by a shaft on which the shuttle is guided.

4. The apparatus of claim 1, wherein the shuttle is on a magnetic or air bearing about a guide shaft.

5. A vibrational apparatus capable of providing a back and forth vibrational output, said apparatus comprising a shuttle able to shuttle reproducibly on a shuttle axis or locus between first and second complementary structures, a mechanical drive to rotate the shuttle about at least part of the shuttle axis or locus, and magnetic interacting regions on at least one of the first and the second complementary structures and on the shuttle whereby rotation of the shuttle has an effect of subjecting the shuttle to shuttle inducing forces, the shuttle inducing forces being alternately attractive and repulsive forces between at least one of the first and the second complementary structures and the shuttle, an output of the shuttle inducing forces is from at least one of said complementary structures and is a back and forth output axially of, or parallel to, said axis.

6. A vibrational apparatus capable of providing a back and forth vibrational output, said apparatus comprising a shuttle rotatable about a defined shuttle axis and moveable back and forth on the shuttle axis, a mechanical drive to rotate the shuttle about the shuttle axis, a first complementary structure towards which and away from which, and vice versa, the shuttle moves, a second complementary structure away from which and towards which, and vice versa, the shuttle moves, the shuttle being located between said complementary structures, proximal regions of each pairing of first complementary structure/shuttle and shuttle/second complementary structure have magnetic areas operable to provide alternatively, for each pairing, attractive or repulsive forces as the shuttle rotates, magnetic phasing between the pairings is such that the shuttle reciprocates on the shuttle axis as a consequence of magnetic interactions that act on the shuttle, a vibrational output is produced from at least one of said complementary structures and is a back and forth output axially of, or parallel to, said axis.

7. The apparatus of claim 6, wherein said first and second complementary structures are fixed relative to each other insofar as distance is concerned.

8. A vibrational apparatus adapted to provide, and capable of providing, a back and forth vibrational output, said apparatus comprising an assembly having a shuttle capable of shuttling movement between complementary structures, at least one of the complementary structures providing a vibrational output, a mechanical drive rotating the shuttle and magnetic interactions occurring between the shuttle and the complementary structures such that the magnetic interactions with each complementary structure, and phasing of the complementary structures relative to the shuttle results in the shuttling movement of the shuttle.

9. The apparatus of claim 8, wherein the magnetic interactions are as a result of permanent magnets.

10. The apparatus of claim 8, wherein the mechanical drive of the shuttle is a belt or other peripheral drive.

11. A drilling apparatus comprising a vibrational head attachable to a drill string, a support, and at least one reconfigurable fluid reservoir to mount the vibrational head on the support, an interaction of the vibrational head, the support and the at least one reconfigurable fluid reservoir has an effect of carrying the weight of an attached drill string yet allowing freedom of movement of the vibrational head relative to the support both longitudinally and laterally of an axis of the drill string, and at least most of the vibrational head, when the drill axis is vertical, is below the at least one reservoir.

12. The apparatus of claim 11, wherein there are at least two fluid reservoirs.

13. The apparatus of claim 12, wherein at least one of the reservoirs is a gas bag.

14. A drilling apparatus comprising a vibrational head attached to a drill string, the vibrational head having a rotatably driven shuttle rotating about a shuttling axis and interacting under rotation with different magnetic effects, a support, at least one gas bag interposed between the vibrational head and a support as a first interaction to carry a weight of the vibrational head and the drill string, and compliant means, as a second interaction, for constraining the vibrational head relative to the support.

15. A vibrational drilling apparatus comprising a vibrational head having a shuttle, a maneuverable support from which the vibrational head is mounted to compliantly vibrate under action of the shuttle, a bearing isolated from vibrational outtake from the vibrational head, and a drill string connector carried by the bearing, a rotational drive for the drill string connector, the shuttle magnetically interacting at each of opposite ends as the shuttle rotates.

16. A vibrational apparatus adapted to provide a vibrational output, said apparatus comprising an assembly having a shuttle capable of shuttling between complementary structures, at least one of the complementary structures providing the vibrational output, a mechanical drive to rotate the shuttle, and magnetic interactions between the shuttle and the complementary structures such that the magnetic interactions with each of the complementary structures, and phasing of the complementary structures relative to the shuttle results in shuttling movement of the shuttle.

* * * * *